United States Patent [19]

Thomas

[11] 4,348,678

[45] Sep. 7, 1982

[54] ANTENNA WITH A CURVED LENS AND FEED PROBES SPACED ON A CURVED SURFACE

[75] Inventor: David T. Thomas, Santa Barbara, Calif.

[73] Assignee: Raytheon Company, Lexington, Mass.

[21] Appl. No.: 207,832

[22] Filed: Nov. 17, 1980

Related U.S. Application Data

[63] Continuation of Ser. No. 962,460, Nov. 20, 1978, abandoned.

[51] Int. Cl.[3] ..... H01Q 3/26

[52] U.S. Cl. ..... 343/754; 343/854

[58] Field of Search ..... 343/853, 854, 753, 754

[56] References Cited

U.S. PATENT DOCUMENTS

| | | | |
|---|---|---|---|
| 3,170,158 | 2/1965 | Rotman | 343/754 |
| 3,230,536 | 1/1966 | Cheston | 343/754 |
| 3,245,081 | 4/1966 | McFarland | 343/754 |
| 3,568,207 | 3/1971 | Boyns et al. | 343/754 |
| 3,754,270 | 8/1973 | Thies | 343/754 |
| 3,755,815 | 8/1973 | Stangel et al. | 343/911 |
| 3,827,055 | 7/1974 | Bogner et al. | 343/754 |
| 3,835,469 | 9/1974 | Chen et al. | 343/754 |
| 3,852,761 | 12/1974 | Bogner | 343/854 |
| 4,070,678 | 1/1978 | Smedes | 343/754 |
| 4,080,605 | 3/1978 | Hilton | 343/754 |

FOREIGN PATENT DOCUMENTS

| | | |
|---|---|---|
| 1166105 | of 0000 | United Kingdom . |
| 1403769 | of 0000 | United Kingdom . |
| 1515787 | of 0000 | United Kingdom . |
| 1543873 | of 0000 | United Kingdom . |
| 1554324 | of 0000 | United Kingdom . |

OTHER PUBLICATIONS

Wide Angle Limited Scan Array Antenna Tech. Study—Tong et al., Raytheon Co., AD-780-048, Note Particularly pg. 4.

*Primary Examiner*—Eli Lieberman

*Attorney, Agent, or Firm*—Richard M. Sharkansky; Joseph D. Pannone

[57] ABSTRACT

A radio frequency energy antenna system for directing a collimated beam of radio frequency energy in free space over relatively wide scan angles. The antenna system includes a plurality of antenna elements disposed along a curved path for producing a directed, noncollimated beam of radio frequency energy and a radio frequency lens disposed between the antenna elements and free space for collimating the radio frequency energy in the directed, noncollimated beam to produce the collimated beam of radio frequency energy in free space. The arrangement of the antenna elements along a curved path produces an amplitude distribution across the collimated beam wavefront which is substantially uniform. A second radio frequency lens has a plurality of array ports coupled to the plurality of antenna elements and a plurality of feed ports, each one being associated with a corresponding collimated beam of radio frequency energy in free space. With such lens the antenna has a relatively wide operating bandwidth. The disposition of the antenna elements along the curved path enables the second lens to be smaller in size and have a shape wherein the array ports and feed ports face one another to a greater degree than if the antenna elements were disposed along a straight line thereby improving the operating effectiveness of the second lens.

14 Claims, 17 Drawing Figures

FIG. 11
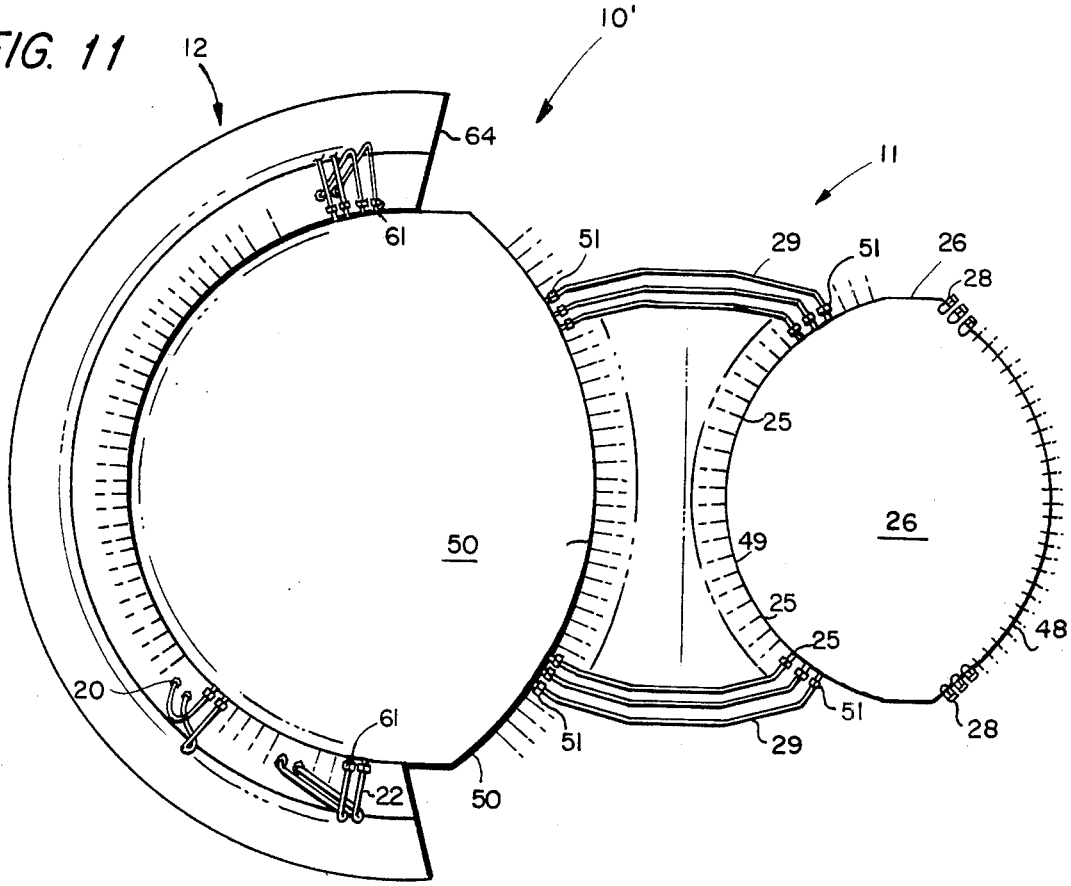
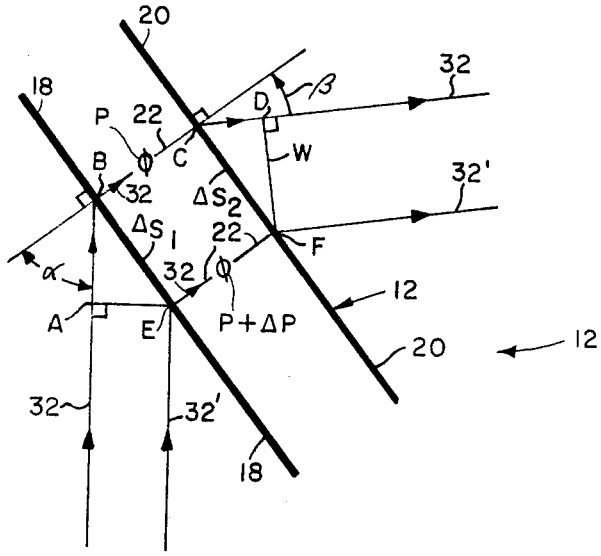
FIG. 2

$R_o = 1.0$
$K = 1.5$
$R_1 = 1.2$
$R_2 = 1.5$
$R_4$ = FLAT OR LINEAR

FIG. 7
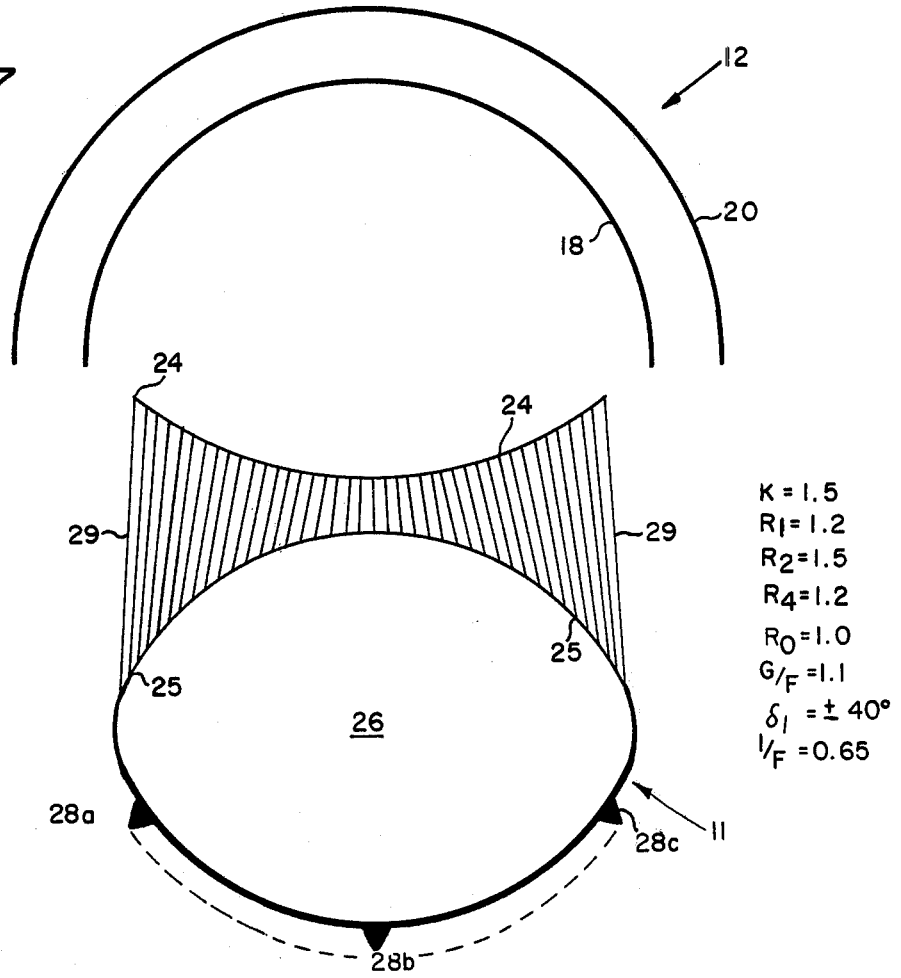
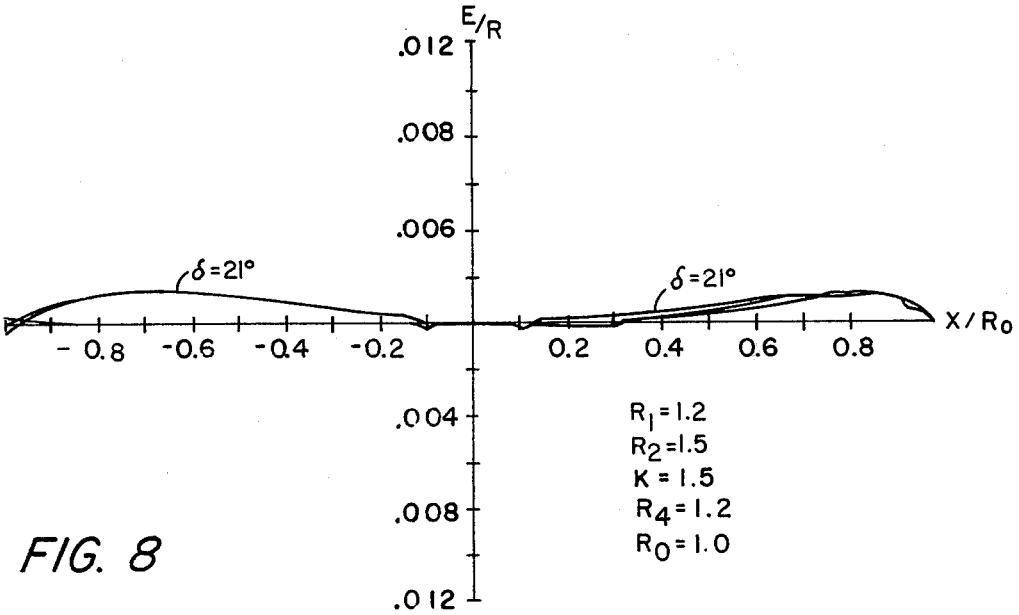
FIG. 8

FIG. 9
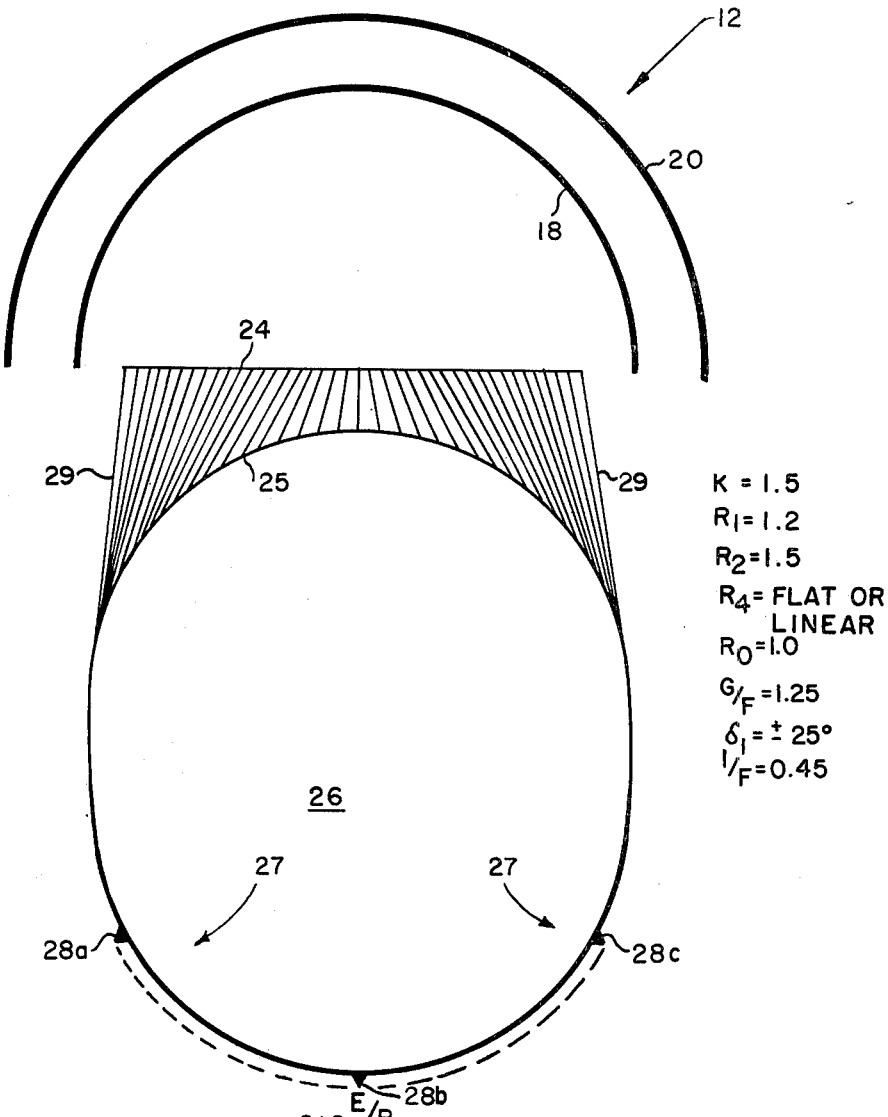
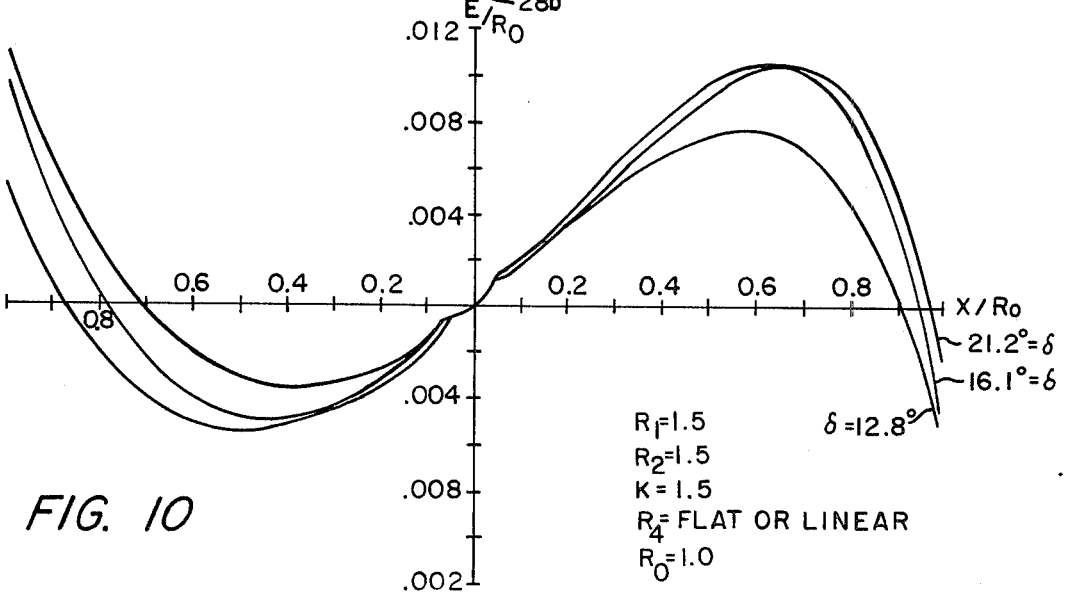
FIG. 10

FIG. 12
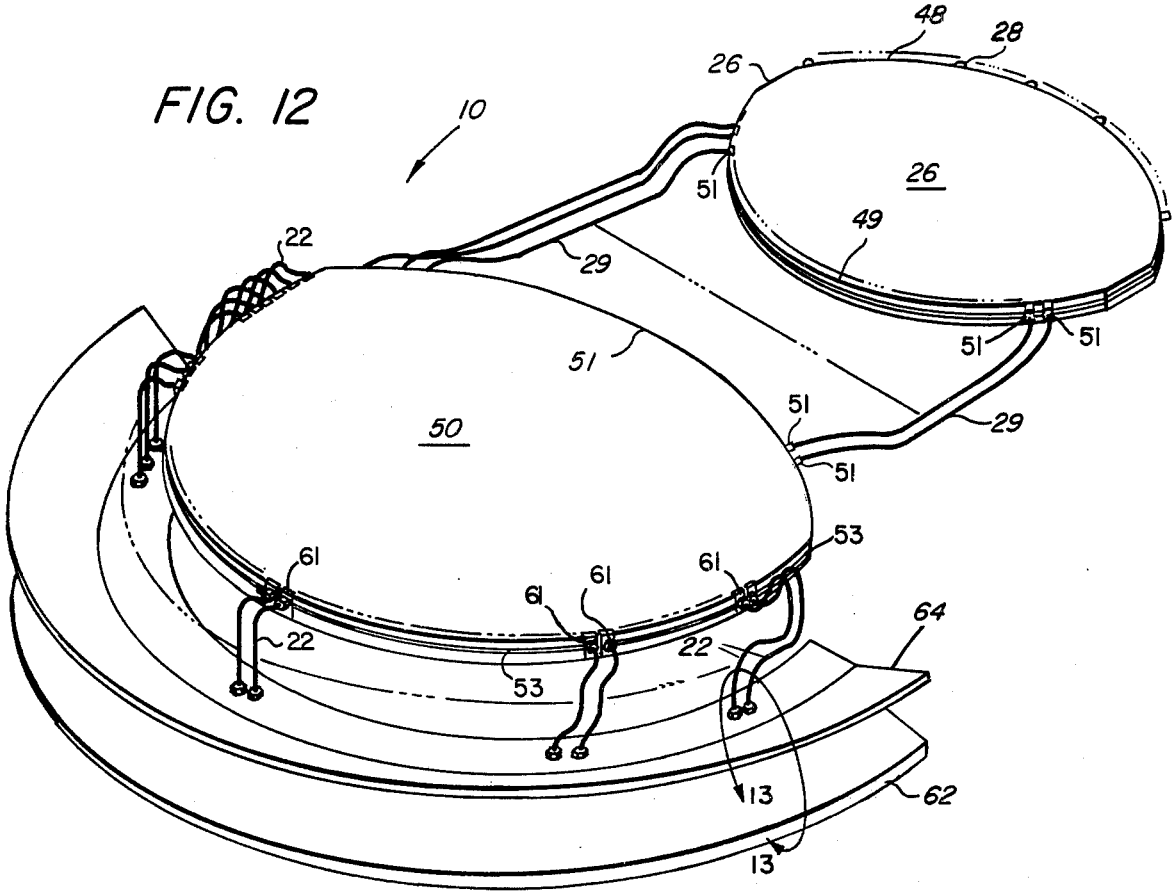
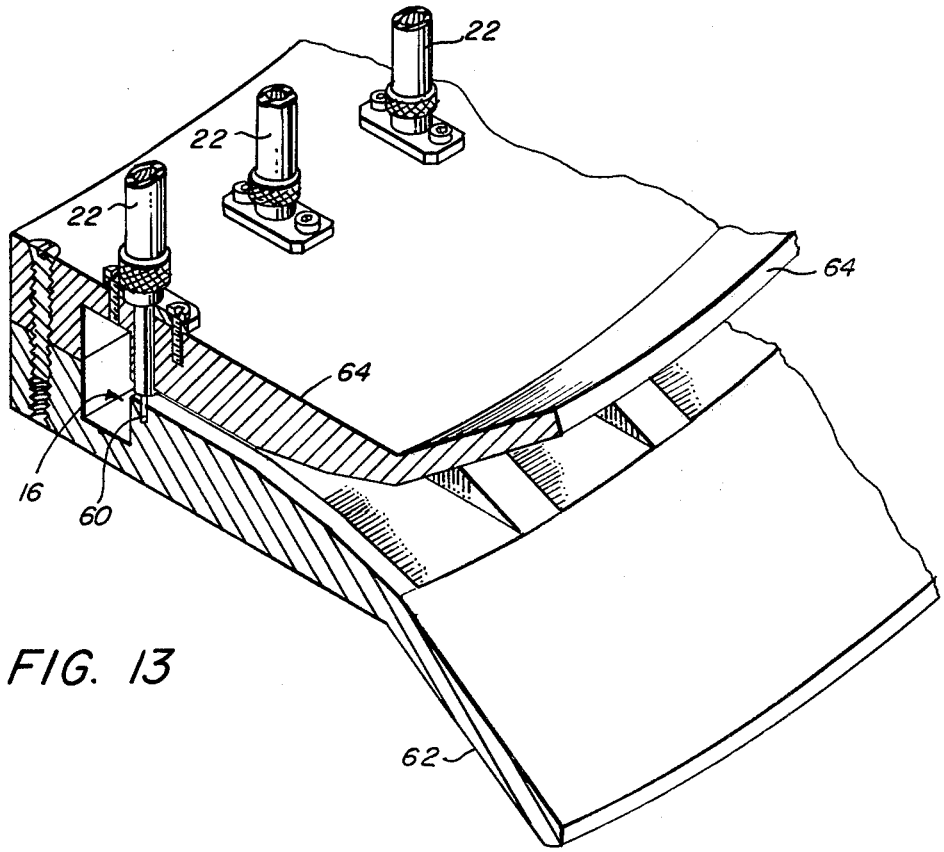
FIG. 13

ANTENNA WITH A CURVED LENS AND FEED PROBES SPACED ON A CURVED SURFACE

CROSS-REFERENCE TO RELATED CASES

This is a continuation of application Ser. No. 962,460, filed Nov. 20, 1978, now abandoned.

BACKGROUND OF THE INVENTION

This invention pertains generally to radio frequency energy antennas and more particularly to antennas adapted to produce electromagnetic beams over wide scan angles.

It has been suggested that a so-called "wide angle scanning array antenna" assembly, as described in U.S. Pat. No. 3,755,815, may be used when it is desired to deflect a radar beam through a deflection angle which may be greater, in any direction, than the maximum feasible deflection angle of a beam from a conventional planar phased array. Briefly, such an antenna assembly consists of a conventional planar phased array mounted within a structure which acts as a lens. When any portion of such structure is illuminated in a controlled fashion by a radar beam from the planar phased array, the direction of such radar beam with respect to the boresight line of the planar phased array is changed in a manner analogous to the way in which a prism bends visible light. Thus, the deflection angle of the radar beam propagated in free space may be caused to be much larger than the greatest deflection angle attainable with a planar phased array.

Although an assembly made in accordance with the disclosure of the cited patent is, in theory, suited to the purpose of deflecting a radar beam through extremely wide deflection angles, the beam is scanned by controlling the phase provided by each one of the phase shifters in the planar phased array, and hence the scan angle is frequency dependent, thereby limiting the bandwidth of the antenna.

SUMMARY OF THE INVENTION

In accordance with the present invention, a radio frequency antenna system is provided for directing a collimated beam of radio frequency energy in free space, such antenna system comprising: curved array means, including a plurality of antenna elements disposed along a nonlinear path, adapted to direct and provide a noncollimated beam of radio frequency energy; and, radio frequency lens means, disposed between the curved array means and free space, adapted to collimate the radio frequency energy in the directed and noncollimated beam to produce the collimated beam of radio frequency energy in free space. With such curved array means, the amplitude distribution of the collimated beam in free space is significantly more uniform across the beam compared with that resulting from a planar array means, thereby improving the performance of the antenna system.

In a preferred embodiment of the invention, a second radio frequency lens means having a plurality of feed ports is included, each one being associated with a corresponding collimated beam of radio frequency energy in free space, adapted for coupling radio frequency energy between each one of the feed ports and the plurality of antenna elements. With such arrangement, the use of phase shifters in the array means is eliminated, thereby increasing the operating bandwidth of the antenna system. The disposition of the antenna elements along the curved path enables the second lens to be smaller in size and have improved effectiveness.

BRIEF DESCRIPTION OF THE DRAWINGS

The foregoing features of this invention, as well as the invention itself, may be more fully understood from the following detailed description read together with the accompanying drawings, in which:

FIG. 2 is a diagram useful in understanding the antenna system of FIG. 1;

FIG. 7 is a diagrammatical sketch of an antenna system according to the invention;

FIG. 8 is a curve showing the path length error of the antenna system shown in FIG. 7;

FIG. 9 is a diagrammatical sketch of an antenna system wherein antenna elements are disposed along a straight line;

FIG. 10 is a curve showing the path length error of the antenna system shown in FIG. 9;

FIG. 11 is a plan view of an antenna system according to the invention;

FIG. 12 is a pictorial view of the antenna system of FIG. 11;

FIG. 13 is a cross-sectional view of a portion of the antenna system of FIG. 12, such portion being encircled by the line 13—13 in FIG. 12;

DESCRIPTION OF THE PREFERRED EMBODIMENTS

Figure 1:
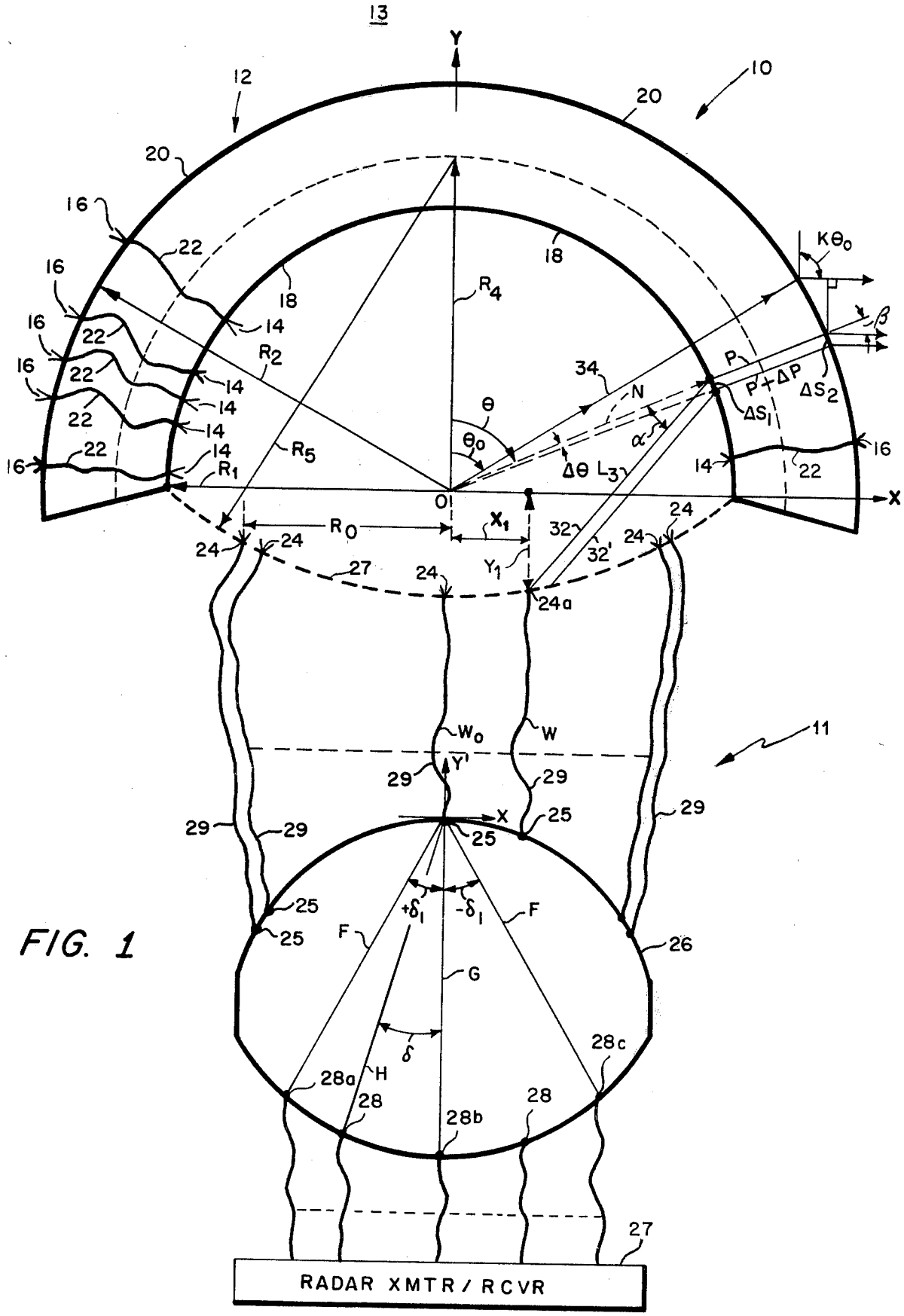
FIG. 1 is a schematic representation of a radio frequency antenna system according to the invention.

Referring now to FIG. 1, a radio frequency antenna system 10 is shown to include: a curved array section 11 adapted to direct and provide a non-collimated beam of radio frequency energy; and, a radio frequency lens 12 disposed between the curved array section 11 and free space 13, adapted to collimate the energy in the directed and non-collimated beam to produce a collimated beam of radio frequency energy in free space. In particular, the radio frequency lens 12 includes a plurality of antenna elements 14, 16 mounted on the inner and outer surfaces 18, 20 thereof, respectively, as shown. Each one of the antenna elements or probes 14 on the inner surface 18 is connected through a transmission line 22 to a corresponding one of the antenna elements 16 on the outer surface 20, as shown. The length of each one of the transmission lines 22 is selected, in a manner to be described, to collimate a beam of radio frequency energy in free space and to increase the deflection angle of such beam in a manner to be described hereinafter. The spacing between the individual antenna elements 14 and individual antenna elements 16 is not critical to the invention so long as the spacing is such as to avoid grating lobes of the operating band of frequencies. The outer surface 20 of the lens 12 is disposed about an outer radius $R_2$ from the center of the lens 12, and the inner surface 18 of the lens 12 is disposed about an inner radius $R_1$ from such center, as shown. The center of lens 12 is at the origin, 0, of an X-Y coordinate system, as shown. It is now apparent that the lens 12 is here similar to a known lens such as the one shown in U.S. Pat. No. 3,755,815 referred to above.

The curved array section 11 includes an array of probes or antenna elements 24 positioned in the near field of the lens 12. The antenna elements 24 are here regularly spaced along an arc of a circle having a radius $R_5$ and centered a length $R_4$ from the center or origin, 0, of the semi-circular lens 12, such that $R_5^2=R_1^2+R_4^2$, as shown. The antenna elements 24 of the curved array means 11 are coupled to array ports 25 of a radio frequency parallel plate lens 26 through individual transmission lines 29, here coaxial cables, as shown. The parallel plate lens 26 has a plurality of feed ports 28 which are coupled to a conventional radar transmission/receiver 27. The shape of the parallel plate lens 26, the length of transmission lines 29, the position of the antenna elements 24 and length of transmission lines 22 are selected in a manner to be described to provide a plurality of collimated beams of radio frequency energy in free space, each one of such beams being associated with a corresponding one of the feed ports 28 of the parallel plate lens 26. The selection of such parameters is described in connection with the following analysis of the antenna system 10. The analysis is based on geometrical optics, or ray optics. This approach is valid when, as here, the lens 12 is in the near field of the curved array section 11.

Referring now also to FIG. 2, the selection of the length of the transmission lines 22 of lens 12 will be discussed. In such FIG. 2 an exploded view of two rays 32, 32' is shown passing through the lens 12, such rays 32, 32' being displaced a small angle $\Delta\theta$ (FIG. 1). The refraction or ray bending caused by the lens 12 may be determined by comparing the electrical path length of such rays 32, 32' as they pass through the lens 12 to points D, F along a common planar wavefront, W. For collimation, the total electrical path length from point A to point B to point C to point D of ray 32 must be equal to the total electrical path length from point E to point F of ray 32'. That is:

$$\overline{ABCD}=\overline{EF} \tag{1}$$

If the displacement between rays 32, 32' along inner surface 18 is $\Delta S_1$ and the displacement between such rays 32, 32' along outer surface 20 is $\Delta S_2$, and if the electrical lengths of the transmission line 22 through which such rays 32, 32' pass are P and $P+\Delta P$, respectively, then from Eq. (1) and FIGS. 1 and 2, $$\Delta S_1 \sin\alpha+P+\Delta S_2 \sin\beta=P+\Delta P \tag{2}$$

where:

$\alpha$=the angle of incidence of ray 32; and $\beta$is the angle of refraction of ray 32.

Since, from FIG. 1, $$\Delta S_1 = R_1\,\Delta\theta \tag{3}$$

and $$\Delta S_2 = R_2\,\Delta\theta$$

where $\Delta\theta$ is small, then from Eqs. (2) and (3)

$$\frac{dP}{d\theta}=\frac{\Delta P}{\Delta\theta}\bigg|_{\Delta\theta\to 0}=R_1\sin\alpha+R_2\sin\beta \tag{4}$$

Considering a "central" ray (i.e. ray 34 (FIG. 1) a ray normal to the lens 12, ($\alpha=0$)) from Eq. (4)

$$\frac{dP}{d\theta}\bigg|_{\theta=\theta_O}=R_2\sin\beta=R_2\sin(K\theta_O-\theta_O) \tag{5}$$

where:

K is the angle amplification factor (i.e., the ratio of the angle of refraction of the central ray 32 to the angle $\theta_0$); and $\theta_0$ is the angle between the central ray 32 and the Y axis, as shown.

From Eqs. (4) and (5)

$$P(\theta_O)=\int_0^{\theta_O} R_2\sin(K\theta_O-\theta_O)\,d\theta_O \tag{6}$$

$$=\frac{R_2}{K-1}[1-\cos(K\theta_O-\theta_O)] \tag{7}$$

where K is a constant for all angles $\theta_0$.

Equation (7) is used to compute the electrical length P of each one of the transmission lines at each angle $\theta_0$ from the vertical axis (4) for a predetermined angle amplification ratio K and outer radius $R_2$.

Having established the electrical lengths of the transmission lines 22, the phase distribution required across the curved array of antenna elements 24 is determined to design of the curved array section 11, in particular the position of the antenna elements 24 and the electrical length of the transmission lines 29.

From FIG. 1 the arc 27 about which the antenna elements 24 are disposed may be represented by the following equation:

$$X^2+(Y-R_4)^2=R_5^2=R_1^2+R_4^2 \tag{8}$$

For an exemplary one of the antenna elements 24, here antenna element **24*a***, at coordinates $X_1$, $Y_1$;

$$X_1=R_1\sin\theta-L_3\sin(\theta-\alpha) \tag{9}$$

$$Y_1=R_1\cos\theta-L_3\cos(\theta-\alpha) \tag{10}$$

where (from FIG. 1):

$L_3$ is the electrical length of ray 32 from antenna element **24*a* to the inner surface 18 of the lens 12**; and $\theta$ is the angular deviation between:

(a) a normal N from the original, 0, of the X-Y coordinate system to the point of intersection of ray 32 and inner surface 18; and (b) the vertical axis, Y.

Substituting Eqs. (9) and (10) into Eq. (8) it may be shown that:

$$L_3 = R_1 \cos \alpha - R_4 \cos (\theta - \alpha) \pm \sqrt{[R_1 \cos \alpha - R_4 \cos (\theta - \alpha)]^2 + 2R_1R_4 \cos \theta} \quad (12)$$

(The choice of sign in Eq. (12) is made according to the physical requirements, that is, positive lengths. The plus sign was used hereinafter). Further, from Eqs. (4) and (5)

$$R_1 \sin \alpha + R_2 \sin \beta = R_2 \sin (K\theta_o - \theta) \quad (13)$$

or $$\sin \alpha = [R_2/R_1] [\sin (K\theta - \theta) - \sin (K\theta_o - \theta)]$$

Therefore, Eq. (12) may be used to compute $L_3$ where $\alpha$ is defined by Eq. (13).

For a predetermined angle amplification ratio K the total differential pathlength $\Delta L$ between the central ray 34, i.e. the ray which passes through X=0, Y=0, and ray 32 may, from FIG. 1, be represented as $$\Delta L = [L_3(\theta) + P(\theta)] - [L_3(\theta_0) + P(\theta_0) + T(\theta)] \quad (14)$$

where $$T(\theta) = R_2[\cos (K\theta_0 - \theta_0) - \cos (K\theta_0 - \theta)] \quad (15)$$

Figure 3:
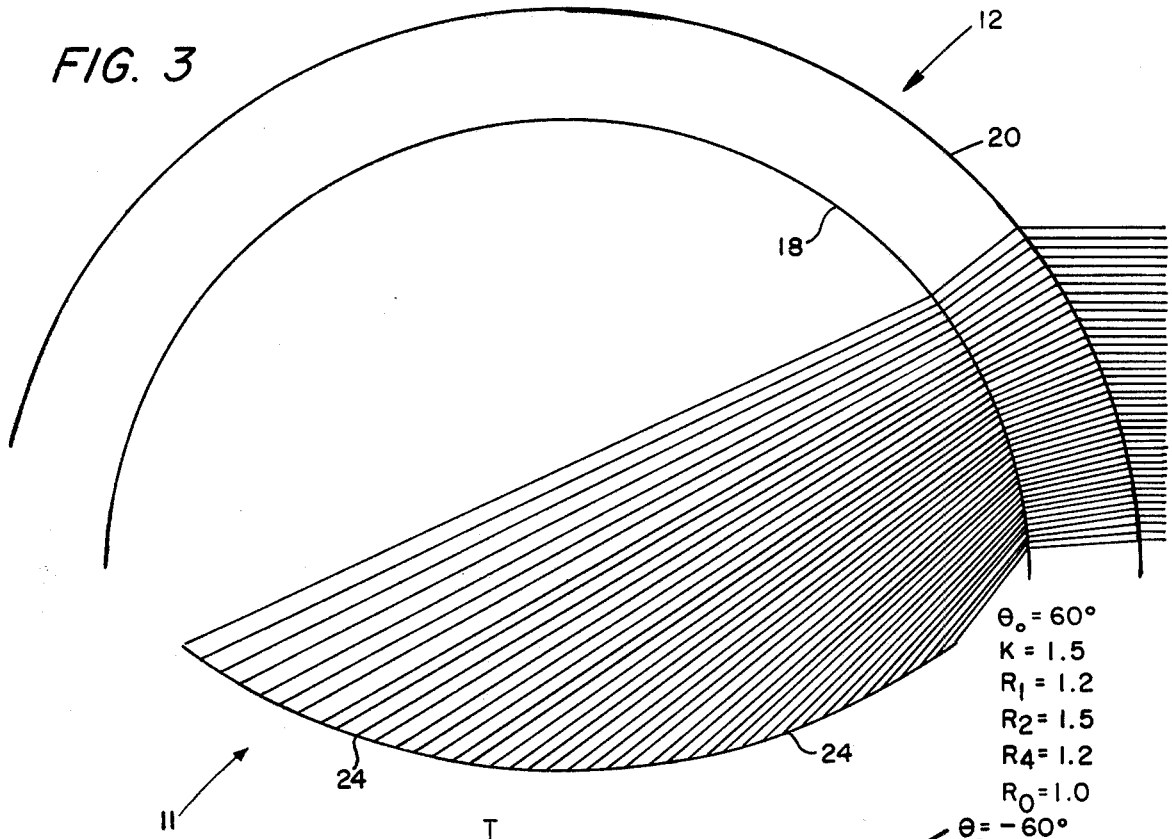
FIG. 3 is a schematic representation of a portion of the antenna system of FIG. 1 including a ray path diagram for a 90° scan angle.
Figure 4:
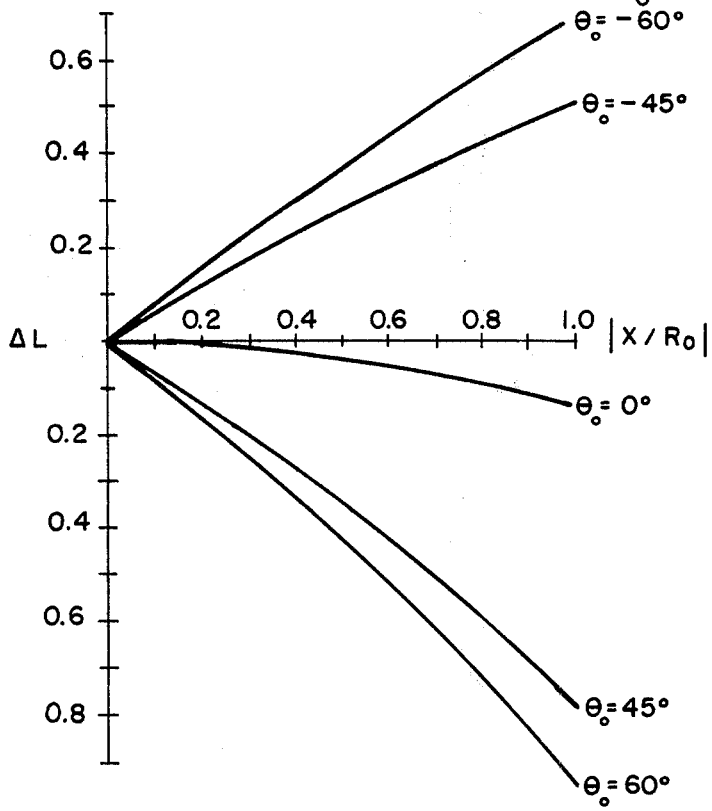
FIG. 4 is a curve showing the path length differences of various rays of the portion of the antenna system shown in FIG. 3.

FIG. 3 shows a ray diagram for a lens 12 having an inner radius $R_1$ of 1.2, an outer radius $R_2$ of 1.5 and an amplification factor K of 1.5. Here the curved array includes antenna elements 24 disposed along an arc of radius $R_5$ of 1.7 (i.e. $R_4$=1.2). A 90° scan is shown, that is $\theta_0$=60 degrees. FIG. 4 shows the differential pathlength $\Delta L$ as a function of $|X/R_0|$ for $\theta_0$=0, ±45°, ±60° for the arrangement shown in FIG. 3 where $R_0$is the length of half of the array 24 measured along the X axis, here 1.0, as shown in FIG. 1. Note that $R_1$, $R_2$, $R_4$, $R_5$ are normalized by $R_0$.

Figure 5:
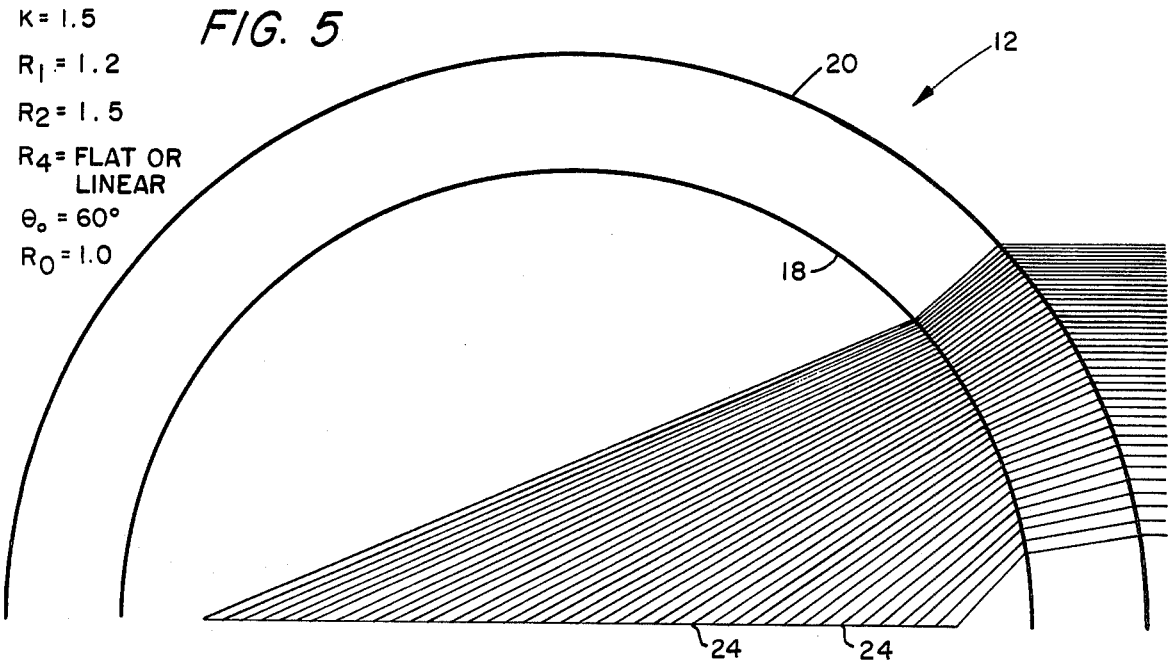
FIG. 5 is a schematic representation of a portion of an antenna system where antenna elements are disposed along a straight line and a ray diagram for a 90° scan angle.
Figure 6:
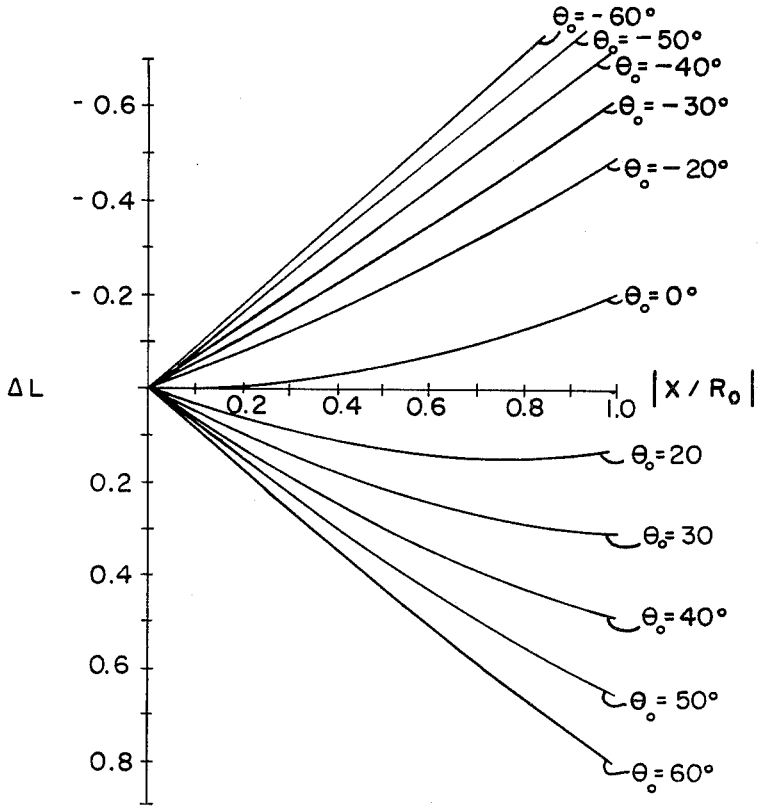
FIG. 6 is a curve showing the path length differences of various rays of the portion of the antenna system shown in FIG. 5.

For comparison, a ray diagram for the lens 12 shown in FIG. 3, here with a linear array of antenna elements 24 ($R_4$="Flat" or "linear"), is shown in FIG. 5. A 90° scan is shown, that is, $\theta_0$=60 degrees. The differential pathlength $\Delta L$ for each arrangement as shown in FIG. 5 is shown in FIG. 6 for $\theta_0$=0°, ±20°, ±30°, ±40°, ±50° and ±60°. From FIGS. 3 and 5 it should be noted that the amplitude distribution across the wavefront is more uniform for the curved array of antenna elements 24 (FIG. 3) than for a linear array of antenna elements 24 (FIG. 5). That is, for the flat or linear array system (FIG. 5) severe amplitude distortion occurs and is visible in the ray density by the "bunching" of rays of the upper portion of the beam for a 90° scan ($\theta_0$=60°). In contrast to this, the curved array in FIG. 3 has very little amplitude distortion as evidenced by the uniform ray densities shown in FIG. 3.

Referring now again to FIG. 1, the disposition of the antenna elements 24 along the arc of radius $R_5$ and the lengths of transmission lines 29 is selected in a manner now to be described to form a noncollimated beam having an angular direction $\theta_0$ of the central ray related to a corresponding one of the feed ports 28 and having a phase distribution across the curved array of antenna elements 24 such that the radio frequency lens 12 collimates the radio frequency energy in the directed and noncollimated beam to produce a collimated beam in free space having an angular deviation $K\theta_o$. That is, the parallel plate lens 26, transmission line lengths 29 and disposition of antenna elements 24 are arranged so that the electrical length from one of the feedports 28 to all points of the wavefront of the corresponding beam in free space is electrically equal. Hence the antenna system 10 is adapted to produce a plurality of collimated beams in free space, each one of such beams corresponding to one of the feed ports 28. (The antenna system 10 may therefore be considered as being a multibeam antenna system). Here feedports **28*a*, 28*b*, 28*c* direct noncollimated beams having angular deviations of −60°, 0° and +60°, respectively. It follows then that the design of the curved array section 11 is such that the electrical lengths from each one of the feed ports 28 to the array of antenna elements 24 are the conjugate of the differential pathlength $\Delta L$ shown in FIG. 4** for $\theta_o$=60°.

As discussed in an article entitled "Wide-Angle Microwave Lens for Line Source Applications" by W. Rotman and R. F. Turner in the November 1963 issue of IEEE Transactions on antennas and propagation, pgs. 623 to 632, and U.S. Pat. No. 3,761,936 entitled "Multibeam Array Antenna", inventors Donald H. Archer, Robert J. Prickett and Curtis P. Hartwig, issued Sept. 25, 1973 and assigned to the same assignee as the present invention, the feed ports 28 may be disposed in an array of arbitrary shape, but must have a definite length or distance parameter, here X, to define the position of each antenna element 24 as exemplary antenna element **24*a* being shown at length or distance X in FIG. 1. Further, three focal points are chosen, two at feed ports 28*a*, 28*c*, i.e. at focal distances F and angles $+\delta_1$ and $-\delta_1$, respectively, and the third at feedport 28*b***, i.e. at focal length G and angle $\delta$=0°.

Considering three arbitrary phase fronts or distribution across the curved array of antenna elements as $P_1(X)$, $P_2(X)$, $P_3(X)$ where $P_1(X)$ is the phase distribution associated with feedport **28*a*, $P_2(X)$ is the phase distribution associated with the feed port 28*c* and $P_3(X)$ is the phase distribution associated with feed port 28*b*. (It is assumed that the phase for all distributions at X=0 is zero, i.e. $P_1(0)=P_2(0)=P_3(0)=0$.) As discussed above, the phase distributions will then be the conjugate of the differential pathlengths $\Delta L$ from the planar wavefronts of beams at $\theta_o$=−60° (scan angle K 60°), $\theta_o$=+60° (scan angle +K60°) and $\theta_o$=0°, respectively. For the analysis below an X, Y′ coordinate system is chosen, such coordinate system being at the center of the arc of the array ports 25 as shown in FIG. 1**.

From FIG. 1 the three pathlength equations may be written as:

$$\sqrt{(F \cos \delta + Y')^2 + (F \sin \delta + X)^2} + W + P_1(X) = F + W_o \quad (16)$$

$$\sqrt{(F \cos \delta + Y')^2 + (F \sin \delta - X)^2} + W + P_2(X) = F + W_o \quad (17)$$

$$\sqrt{(G + Y')^2 + X^2} + W + P_3(X) = G + W_o \quad (18)$$

where $W_o$ is the electrical length of the central one of the transmission lines 29; and W is the electrical length of the transmission line 29 at a distance X from the Y or Y′ axis.

In solving Equations (16), (17) and (18) $W_o$ will be assumed zero for simplification, it being realized that the addition or subtraction of equal pathlengths will not change the analytical design of the curved array section 11. To further simplify the analysis the antenna system 10 is symmetrical about the Y or Y' axis for both the lens 12 and the parallel plate lens 26.

Equations (16), (17) and (18) may be rearranged as:

$$X = \frac{[P_1(X) - P_2(X)]}{4F \sin \delta} \{(P_1(X) + P_2(X) - 2F) + 2W\} = X_0 + X_1 W \quad (19)$$

$$Y' = -\frac{1}{2(G - F\cos\delta)}\left\{\left(\frac{P_1^2(X)}{2} + \frac{P_2^2(X)}{2} - P_3^2(X) + 2G\,P_3(X) - FP_1(X) - FP_2(X)\right) + 2W(G - F + P_1(X) + P_2(X) - 2P_3(X))\right\} = -(Y_0 + WY_1) \quad (20)$$

Substituting Eqs. (19) and (20) into Equation (18) yields a quadradic in W:

$$AW^2 + 2BW + C = 0 \quad (21)$$

where $$A = 1 - X_1^2 - Y_1^2$$
$$B = P_3(X) - G + Y_1 G - X_0X_1 - Y_0Y_1$$
$$C = P_3^2(X) - 2G\,P_3(X) + 2G\,Y_0 - Y_0^2 - X_0^2$$

That is, $$W(X,\gamma) = \frac{-B \pm \sqrt{B^2 - AC}}{A} \quad (22)$$

where X and Y are found from Eqs. (19) and (20). The choice of sign in Eq. 22 is made to assure that the results satisfy the original pathlength Equations (16), (17) and (18).

This completes the design of the curved array section 11. That is, for three phase distributions $P_1(X)$, $P_2(X)$, $P_3(X)$ the X,Y position of the antenna elements 24 and the electrical lengths W of the transmission lines 29 may be calculated for a parallel plate lens 26 having predetermined focal distances F and G to provide three "perfect" focal points, i.e. three "perfect" differential pathlengths at $\theta_0=0°$, $-60°$, $+60°$ to enable collimation by the lens 12 of scan angles of 0°, −K 60° and +K 60°, respectively.

At beam ports 28 between or intermediate the three "perfect" focal points (i.e. feed ports 28*a*, 28*b*, 28*c*) pathlength errors will occur. The amount of pathlength error depends on two factors: (1) the phase distribution $P_n(X)$ required by the lens 12 at some intermediate scan angles (i.e. intermediate scan angles −K 60°, 0°, +K 60°) and (2) the pathlengths provided by the parallel plate lens 26 for the corresponding intermediate ones of the feed ports 28. The pathlength L' provided by the parallel plate lens 26 from a feed port 28 at an angle $\gamma$ and at a length H to the antenna elements 24 at distance X may be determined by:

$$L'(X,\gamma,H) = \sqrt{(H\cos\gamma + Y')^2 + (H\sin\gamma + X)^2} + W \quad (23)$$

The total pathlength error of the entire antenna system 10 will therefore be:

$$E(X,\theta) = \Delta L - (L' - H) \quad (24)$$

FIG. 7 shows an antenna system having the semicircular radio frequency lens 12 (i.e. $R_1=1.2$, $R_2=1.5$, $R_4=1.2$, $K=1.5$) shown in FIG. 3 with a curved array section 11 designed to provide "optimum" performance, "optimum" being loosely defined in terms of lens size, lens shape, geometry to enable the feed ports 28 and the array ports 25 to be "facing" and pathlength error for intermediate feed ports 28. For such design $G/F=1.10$, $\delta_1=\pm 40°$, $1/F=0.65$. FIG. 8 shows the overall path length error E at intermediate unfocused scan angles over as a function of $X/R_o$. As noted, the peak error spread (maximum negative error to maximum position error) is in the order of $0.00185R_o$.

For comparison, FIG. 9 shows the "optimum" parallel plate lens 26 design for a linear array of antenna elements using the same lens configuration (i.e. $R_1=1.2$, $R_2=1.5$, $K=1.5$) as shown in FIG. 5. Here $G/F=1.25$, $\delta_1=\pm 25°$, $1/F=0.45$). It should first be noted that the size of the parallel plate lens 26 is about 50% larger than the parallel plate lens shown in FIG. 7 using a curved array of antenna elements 24. Further, the shape of the parallel plate lens in FIG. 9 is relatively inefficient since it is more circular in shape than the parallel plate lens shown in FIG. 7, that is, because the extreme portions 27 of the feed ports 25 are not opposing the arc of array ports 25 thereby reducing the effectiveness of the lens 26. Error (E) for this system is shown in FIG. 10. Note that the error (E) spread is here $0.015R_o$.

Referring now to FIGS. 11 and 12, an antenna system 10' is shown to include a parallel plate lens 26 here designed as described above having a plurality of feed ports 28 along one portion of its periphery (i.e. portion 48) and a plurality of array ports 25 disposed about an opposite portion of the periphery (portion 49). The parallel plate lens 26 is coupled to a parallel plate section 50 through transmission lines 29, as shown. The transmission lines 29 are here coaxial cables and connect the array ports 25 of the parallel plate lens 26 to the parallel plate section 50 using conventional coaxial connectors 51, as shown. The parallel plate section 50 is used to confine the radiation between the lens 12 and the parallel plate lens 26 to a single two-dimensional plane.

Figure 14:
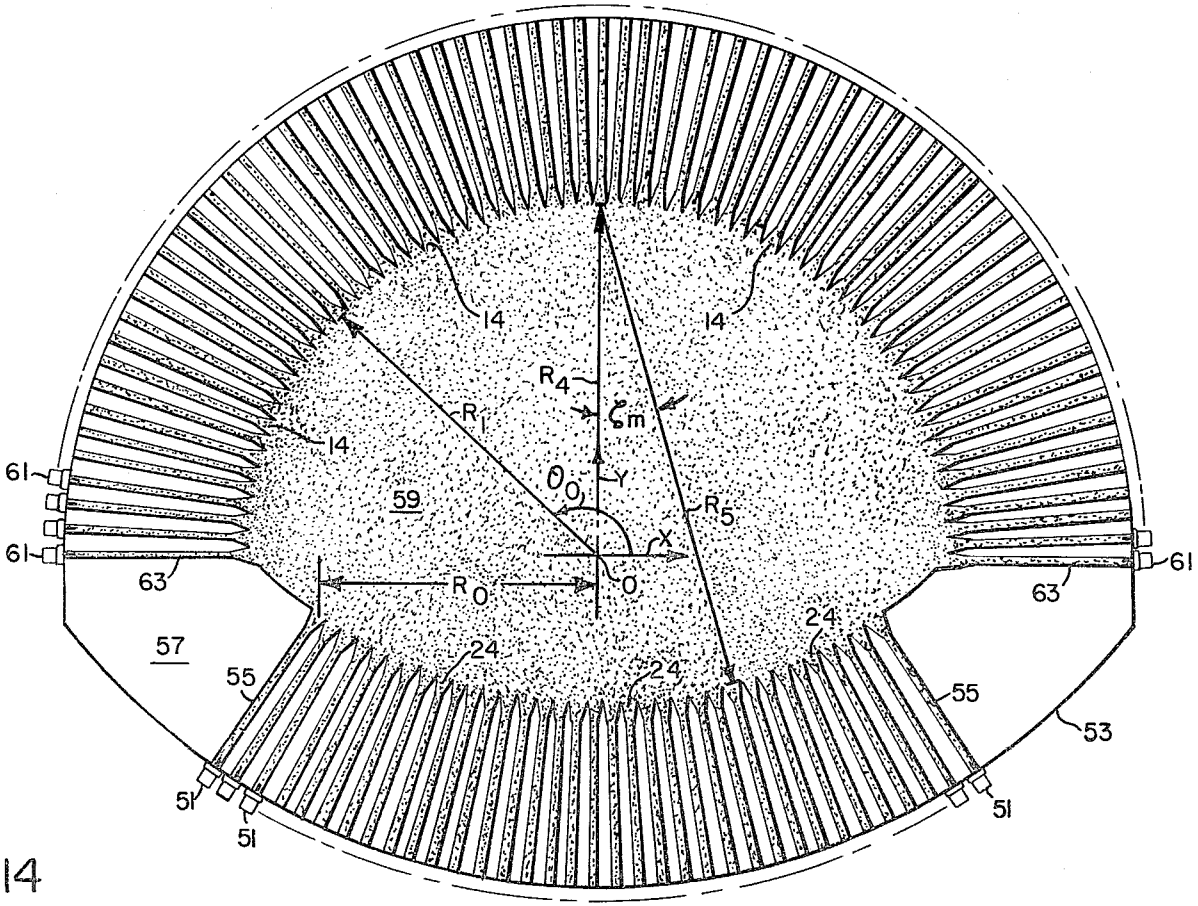
FIG. 14 is a plan view of center conductor circuitry of a stripline lens parallel plate section used in the antenna system of FIG. 13.

The parallel plate section 50 is here of stripline construction having strip or center conductor circuitry 53 disposed between a pair of ground planes. The strip or center conductor circuitry 53 is shown in FIG. 14. Such circuitry 53 is formed on a suitable dielectric substrate 57 by suitably etching a copper clad, dielectric substrate 57 using conventional photolithographic and chemical etching techniques. The coaxial connectors 51 on the parallel plate section 50 are connected to strip transmission lines 55 which terminate into antenna elements 24, as shown. The strip transmission lines 55 are of equal length and are used to enable sufficient mounting space for the coaxial connectors 51. As shown in FIG. 14, the antenna elements 24 are disposed along an arc of radius $R_5$ where $R_5^2=R_1^2+R_4^2$ and where here $R_4$ is shown equal to $R_1$. Further, the length of the array of antenna elements 24 is here $2R_o$, as shown. The antenna elements 24 are formed along a portion of the periphery of a conductive region 59, as shown. Disposed along an opposite portion of the conductive region 59 are the antenna elements 14, as shown. Such antenna elements 14 are coupled to coaxial connectors 61, through strip transmission lines 63, as shown. The strip transmission lines 63 are of equal length and are used to enable sufficient mounting mounting space for the coaxial connectors 61.

The coaxial connectors 61 are connected to transmission lines 26, as shown. The transmission lines 22 are here coaxial cables of proper electrical length as discussed in connection with Equation (7) above. As shown in FIG. 13, ends of the coaxial cables 22 provide the antenna elements 16. That is, the outer conductors of the cables 22 are electrically connected to a first conductive member 64 and the center conductors 60 of such cables 22 are connected to a second conductive member 64. The conductive members 62, 64 form a ribbed, flared radiating structure for the antenna system. It is noted that the antenna elements 16 are disposed along an arc of radius $R_2$ as discussed in connection with FIG. 1.

Figure 15A:
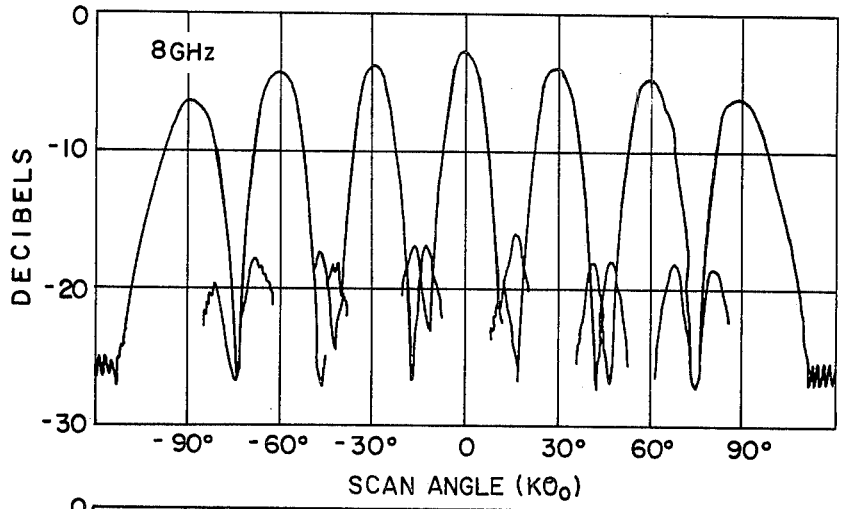
FIGS. 15*a*, 15*b*, 15*c* show antenna patterns of the antenna system of FIG. 12.
Figure 15B:
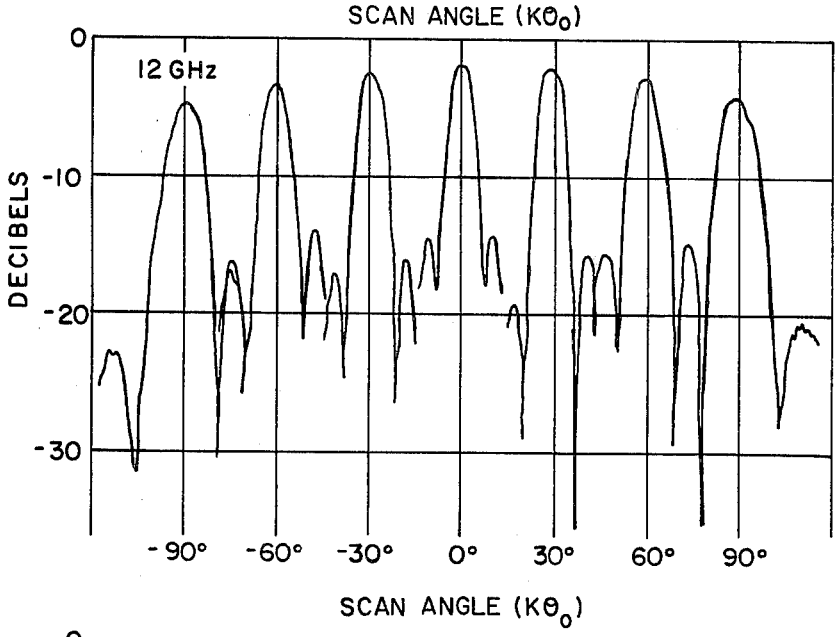
Figure 15C:
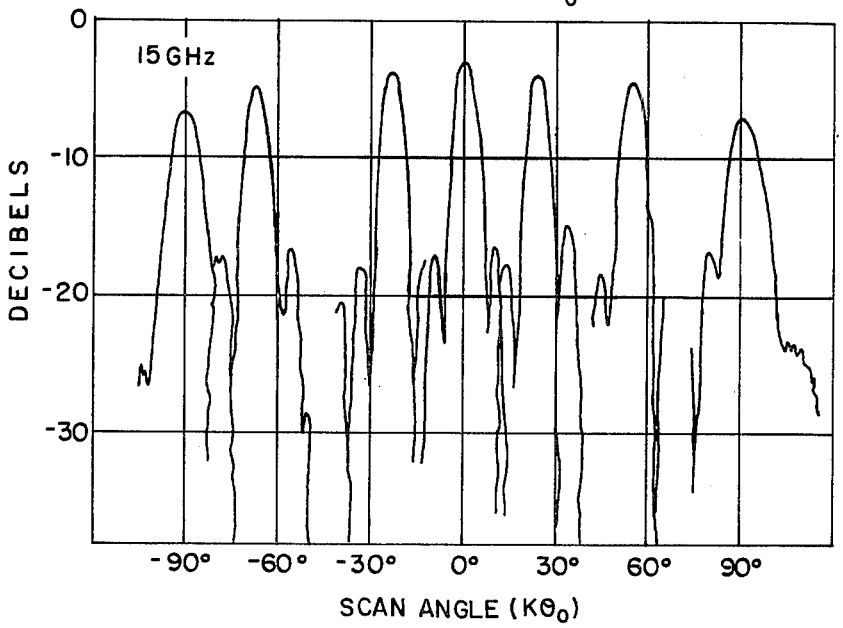

Referring now to FIGS. 15*a*, 15*b*, 15*c*, antenna patterns are shown for the antenna system shown in FIG. 12 operating at frequencies of 8 GHz, 12 GHz and 15 GHz, respectively, over a ±90° total scan angle, i.e. $\theta_o$ from −60° to +60° where K=1.5; $R_1/R_o=1.2$; $R_4/R_o=1.2$; and $R_2/R_o=1.5$. The actual value of $R_o$ is selected in accordance with the desired beamwidth and operating band of frequencies. For an operating band in the order of 8 to 15 GHz and a 6° beamwidth a length $R_o$ of 6.05 inches (in air dielectric) is typical. It is noted that the length $R_o$ must be scaled in a well known manner, by the dielectric constant used, i.e. here by the dielectric constant of substrate 57 (FIG. 14). For the lens 26, here $F=R_o/0.65$; $G=1.10F$; and $\delta_1=\pm 40°$. Also, thirty-five array ports 25 and twenty-nine feed ports 28 were used in the lens 26.

The design of the lens 26 may be determined in accordance with Equations (19), (20) and (22) above. Here other positions for the thirty-five array ports 25 and the length of the coaxial cables 29 are as follows:

| Array Ports 25 | X (inches) | −Y′ (inches) | W (inches) |
|---|---|---|---|
| #1, #35 | ±6.416 | 4.051 | 2.094 |
| #2, #34 | ±6.193 | 3.582 | 1.837 |
| #3, #33 | ±5.939 | 3.140 | 1.598 |
| #4, #32 | ±5.656 | 2.727 | 1.379 |
| #5, #31 | ±5.346 | 2.346 | 1.178 |
| #6, #30 | ±5.015 | 1.992 | 0.994 |
| #7, #29 | ±4.663 | 1.669 | .829 |
| #8, #28 | ±4.292 | 1.376 | .679 |
| #9, #27 | ±3.905 | 1.114 | .547 |
| #10, #26 | ±3.505 | 0.880 | .431 |
| #11, #25 | ±3.089 | 0.674 | .328 |
| #12, #24 | ±2.669 | 0.496 | .240 |
| #13, #23 | ±2.235 | 0.342 | .165 |
| #14, #22 | ±1.797 | 0.220 | .106 |
| #15, #21 | ±1.354 | 0.125 | .061 |
| #16, #20 | ±0.912 | 0.055 | .025 |
| #17, #19 | ±0.455 | 0.013 | .006 |
| #18 | .0 | .0 | .0 |

Here the positions for the twenty-nine feed ports 28 are as follows:

| Feed Ports 28 | δ (degrees) | H (inches) |
|---|---|---|
| #1, #29 | ± 40 | 9.308 |
| #2, #28 | ± 36.78 | 9.383 |
| #3, #27 | ± 33.67 | 9.478 |
| #4, #26 | ± 30.64 | 9.580 |
| #5, #25 | ± 27.68 | 9.683 |
| #6, #24 | ± 24.77 | 9.782 |
| #7, #23 | ± 21.91 | 9.873 |
| #8, #22 | ± 19.09 | 9.957 |
| #9, #21 | ± 16.30 | 10.030 |
| #10, #20 | ± 13.54 | 10.093 |
| #11, #19 | ± 10.80 | 10.145 |
| #12, #19 | ± 8.09 | 10.186 |
| #13, #17 | ± 5.39 | 10.215 |
| #14, #16 | ± 2.69 | 10.233 |

-continued

| Feed Ports 28 | δ (degrees) | H (inches) |
|---|---|---|
| #15 | .0 | 10.238 |

It is noted that all dimensions are given for air dielectric and the actual lens dimensions and cable lengths are reduced by the refraction index of the material used in accordance with well known practice.

With regard to the circular lens 12, here sixty-nine antenna elements 14 (and sixty-nine antenna elements 16) equally spaced in angle over 180°, with end elements at 0° and 180°, respectively. Hence, the angular location of the elements, $\theta_o$, may be represented by the following equation:

$$\theta_o=90°-2.6471°\ (n-1)$$

where n=1, ±2, ±3 . . . ±35, as shown in FIG. 14 for antenna elements 14. The antenna elements 24 are regularly spaced along an arc having a radius $R_5$, as shown in FIG. 14, and such spacing may be represented by the following equation:

$$\zeta_m=2.0631°\ (m-18)$$

where m=0, 1, 2 . . . 35 and $\zeta_m$ is the angle between the Y axis and the radius $R_5$ to the mth antenna element 24, as shown in FIG. 14.

Having described a preferred embodiment of this invention, it is evident that other embodiments incorporating these concepts may be used. For example, while a two-dimensional antenna system has been described to provide a fan-shaped beam, a plurality of such systems may be stacked to form a planar antenna system to provide a beam with a planar cross-section. It is felt, therefore, that this invention should not be restricted to the disclosed ebodiments, but rather should be limited only by the spirit and scope of the appended claims.

What is claimed is:

1. A radio frequency antenna system for producing collimated beams of radio frequency energy in free space, comprising:

(a) curved array means for providing differently directed, noncollimated beams of radio frequency energy, each one disposed along a first nonlinear path, the direction of the noncollimated beams being produced in accordance with the distribution of the phase of the radio frequency energy across the first nonlinear path of the common aperture, each one of such noncollimated beams having a different phase distribution across the first nonlinear path of the common aperture; and (b) radio frequency lens means, disposed between the curved array means and free space, for collimating the radio frequency energy in the directed, noncollimated beams to produce corresponding collimated and angularly redirected beams of radio frequency energy in free space, such radio frequency lens means comprising:

(i) antenna means disposed along a second nonlinear path;

(ii) a second probe means disposed along a third nonlinear path, such directed noncollimated beams being provided between the first probe means and the second probe means; and (iii) means for providing fixed, predetermined electrical length coupling between the antenna means and the second probe means.

2. The antenna recited in claim 1 wherein the curved array means includes a second radio frequency lens means having array port means coupled to the first probe means and also having a plurality of feed ports coupled to the array probe means, each one of such feed ports being associated with a corresponding one of the collimated beams of radio frequency energy in free space, each one of the plurality of feed ports being coupled to the array port means.

3. A radio frequency antenna, comprising:

(a) means for providing directed, noncollimated beams of radio frequency energy, such means including:

(i) a radio frequency lens having a plurality of array ports and a plurality of feed ports disposed along curved outer opposing convex shaped peripheral portions of the lens, each one of such feed ports being associated with a corresponding one of the directed, noncollimated beams of radio frequency energy; and (ii) a first plurality of probes disposed along a first nonlinear path for providing a common aperture for the directed, noncollimated beams, each one of such first plurality of probes being coupled to a corresponding one of the array ports; and (b) radio frequency lens means, disposed between the first plurality of probes and free space, for collimating and angularly redirecting the radio frequency energy in the directed, noncollimated beams producing corresponding collimated beams of radio frequency energy in free space, such radio frequency lens means comprising:

(i) a plurality of antenna elements disposed along a second nonlinear path;

(ii) a second plurality of probes disposed along a third nonlinear path, such directed, noncollimated beams being provided between the first and second pluralities of probes; and (iii) a plurality of tranmission lines, each one thereof providing a different, fixed, predetermined electrical length between a corresponding one of the antenna elements and a corresponding one of the second plurality of probes.

4. The radio frequency antenna recited in claim 3 wherein the second nonlinear path is an arc of radius $R_1$ and the third nonlinear path is disposed along an arc of radius $R_2$ where $R_2 > R_1$ and wherein the arc of radius $R_1$ and the arc of radius $R_2$ have a common origin.

5. The radio frequency antenna recited in claim 4 wherein the first plurality of probes coupled to the array ports is disposed along an arc of radius $R_5$, such arc being centered a distance $R_4$ from the origin of the arc of radius $R_1$, where $R_1^2 + R_4^2 = R_5^2$.

6. A radio frequency antenna, comprising:

(a) a first radio frequency lens having an array means disposed along a peripheral portion of the lens and a plurality of feed ports disposed along a second, opposing peripheral portion of the lens, such first and second peripheral portions being separated by a central portion of the lens, such peripheral portions being convex outwardly from the central portions of the lens, each one of such plurality of feed ports being coupled to such array means through the central portion of the lens, each one of such feed ports being associated with a corresponding one of a plurality of beams of radio frequency energy in free space;

(b) probe means disposed along a first nonlinear path to provide a common aperture for each one of the plurality of beams, such probe means being coupled to the array means;

(c) a second radio frequency lens, comprising:

(i) a plurality of probe points disposed along a second nonlinear path; and (ii) a plurality of antenna points disposed along a third nonlinear path, the antenna points being coupled to the probe points through fixed, predetermined electrical lengths.

7. The radio frequency antenna recited in claim 6 wherein: The second nonlinear path is an arc of radius $R_1$; the third nonlinear path is an arc of radius $R_2$; and the first nonlinear path is in an arc of radius $R_5$, such arc being centered a distance $R_4$ from the center of the arc of radius $R_1$, where $R_1^2 + R_4^2 = R_5^2$.

8. A radio frequency antenna comprising:

(a) array means, including a plurality of probes, disposed along a first nonlinear path, such plurality of probes providing a common aperture, for producing, from such common aperture, noncollimated beams of radio frequency energy, each one of such beams having a central ray at a different angle $\theta_o$ with respect to a reference axis;

(b) radio frequency lens means, disposed between the plurality of probes and free space for collimating the noncollimated beams and angularly redirecting such collimated beams at correspondingly different angles, such radio frequency lens means comprising:

(i) probe means disposed along a second nonlinear path, such noncollimated beams being disposed between the plurality of probes and the probe means;

(ii) antenna means disposed along a third nonlinear path; and (iii) means for providing fixed, predetermined electrical length coupling between the probe means and the antenna means.

9. The radio frequency antenna recited in claim 8 wherein the antenna means is disposed along an arc of radius $R_2$ and the probe means is disposed along an arc of radius $R_1$ where $R_2 > R_1$ and wherein the coupling means provides an electrical length P between points of the probe means and corresponding points of the antenna means, where:

$$P = R_2/K - 1(1 - \cos(K\theta'_o - \theta'_o))$$

where $\theta'_o$ is the angular orientation of the one of the points of the probe means with respect to the reference axis and K is a nonunity constant.

10. The radio frequency antenna recited in claim 9 wherein the plurality of probes is disposed along an arc of radius $R_5$, such arc being centered at a distance $R_4$ from the center of the arc of radius $R_1$, where $R_5^2 = R_1^2 + R_4^2$.

11. The radio frequency antenna recited in claim 10 where $K > 1$.

12. The radio frequency antenna recited in claim 8 wherein the noncollimated beam producing means includes: a second radio frequency lens having a plurality of array ports coupled to the plurality of probes, a plurality of feed ports each one thereof being coupled to the plurality of array ports, and wherein each one of the plurality of feed ports is associated with a corresponding one of the collimated beams of radio frequency energy.

13. The radio frequency antenna recited in claim 12 wherein the antenna means is disposed along an arc of radius $R_2$ and the probe means is disposed along an arc of radius $R_1$, where $R_2 > R_1$, and wherein the coupling means provides an electrical length P between points of the probe means and corresponding points of the antenna means where $$P = R_2/K - 1(1 - \cos(K\theta'_o - \theta'_o))$$

where $\theta'_o$ is the angular orientation of the one of the points of the probe means with respect to the reference axis, and K is a nonunity constant.

14. A radio frequency antenna system for producing collimated beams of radio frequency energy in free space over relatively wide scan angles, comprising:

(a) parallel plate lens means for providing directed, noncollimated beams of radio frequency energy from a common aperture, such aperture comprising a first plurality of probes disposed along a first nonlinear path, such parallel plate lens means comprising:

(i) a parallel plate lens having a curved outer peripheral input portion and an opposing curved outer peripheral output portion;

(ii) a plurality of transmitter/receiver feed ports coupled to the curved outer peripheral input portion of the parallel plate lens;

(iii) a first plurality of transmission lines coupled to the curved peripheral output portion of the parallel plate lens, each one of the first plurality of transmission lines having a predetermined electrical length and each one thereof being coupled to a corresponding one of the first plurality of probes; and (b) radio frequency lens means, disposed between the parallel plate lens means and free space, for collimating and angularly redirecting the radio frequency energy in the directed, noncollimated beams to produce collimated beams of radio frequency energy in free space over the relatively large scan angles, such radio frequency lens means comprising:

(i) a plurality of antenna elements disposed along a second nonlinear path;

(ii) a second plurality of probes disposed along a third nonlinear path, such directed noncollimated beams being provided between the first and second pluralities of probes; and (iii) a second plurality of transmission lines, each one thereof being coupled to provide a fixed, predetermined electrical length between a corresponding one of the antenna elements and a corresponding one of the second plurality of probes.

* * * * *